US006488470B1

(12) United States Patent
Owczarek

(10) Patent No.: US 6,488,470 B1
(45) Date of Patent: Dec. 3, 2002

(54) ANNULAR FLOW DIFFUSERS FOR GAS TURBINES

(76) Inventor: Jerzy A. Owczarek, 2345 Overlook Dr., Bethlehem, PA (US) 18017-3738

( * ) Notice: Subject to any disclaimer, the term of this patent is extended or adjusted under 35 U.S.C. 154(b) by 0 days.

(21) Appl. No.: 09/398,863

(22) Filed: Sep. 20, 1999

Related U.S. Application Data

(63) Continuation-in-part of application No. 09/366,478, filed on Aug. 3, 1999, now Pat. No. 6,261,055.

(51) Int. Cl.[7] ..... F01B 25/02; F01D 1/02
(52) U.S. Cl. ..... 415/148; 415/211.2; 415/207
(58) Field of Search ..... 415/148, 150, 415/208.1, 208.2, 210.1, 211.2, 207

(56) References Cited

U.S. PATENT DOCUMENTS 6,261,055 B1 * 7/2001 Owczarek ..... 415/148

OTHER PUBLICATIONS

P.G. Hill, U.W. Schaub, Y. Senoo, Turbulent Wakes in Pressure Gradient, Transactions ASME, Journal of Applied Mechanics, vol. 85, Series E, pp. 518–524, Dec. 1963.
R.W. Fox, S.J. Kline, Flow Regimes in Curved Subsonic Diffusers, Transactions ASME, Journal of Basic Engineering, vol. 84, Series D, pp. 303–316, Sept. 1962.
J.R. Henry, C.C. Wood, S.W. Wilbur, Summary of Subsonic–Diffuser Data, NACA RM L56F05, 1956.
G. Sovran, E.D. Klomp, Experimentally Determined Optimum Geometries for Rectilinear Diffusers with Rectangular, Conical or Annular Cross Section, in: Fluid Mechanics of Internal Flow, Elsevier Publishing Company, Amsterdam, Netherlands, 1967, (Fig. 17 on p. 291, and Appendix B on pp. 311 and 312).
J.H.G. Howard, A.B. Thornton–Trump, H.J. Henseler: Performance and Flow Regimes for Annular Diffusers, ASME Paper 67–WA/FE–21, 1967.

(List continued on next page.)

*Primary Examiner*—John Ryznic
(74) *Attorney, Agent, or Firm*—Charles A. Wilkinson

(57) ABSTRACT

An annular diffuser has its inlet located at the exit of a last row of blades of a gas turbine having initially very slowly increasing cross-sectional area with distance to accommodate the diffusion produced by the decaying wakes in the diffuser so as to prevent flow separation from diffuser walls and as a result to foster the diffusion process and to increase the efficiency of the gas turbine. The rate of increase of cross-sectional area, which is much smaller than that appropriate in diffusers having uniform flow at their inlets, allows wakes which form near the trailing edges of the last turbine blades to dissipate while avoiding flow separation. In the diffuser of this invention, at a distance from inlet of one half of diffuser height at inlet, the cross-sectional area increase is smaller than 6.5% of the inlet cross-sectional area. This is equivalent to the corresponding two-dimensional straight-wall diffuser angle of, approximately 3.7 degrees.

12 Claims, 5 Drawing Sheets

OTHER PUBLICATIONS

M.Ye. Deich, A.Ye. Zaryankin, Gas Dynamics of Diffusers and Exhaust Ducts of Turbomachines, translated by Foreign Technology Division, Wright–Patterson AFB, Ohio, report No. FTD–MT–24–1450–71. Available from Clearinghouse for Federal and Scientific Information, Springfield, VA, as report No. AD 745470, 1970.

Steam Turbines for Large Power Outputs, von Karman Institute for Fluid Dynamics, Lecture Series 1980–6, Rhode Saint Genese, Belgium, 586 pp., Apr. 21–25, 1980.

Y. Senoo, N. Kawaguchi, T. Kojima, M. Nishi: Optimum Strut Configuration for Downstream Annular Diffusers with Variable Swirling Inlet Flow, Transactions ASME, Journal of Fluids Engineering, vol. 103, pp. 294–298, Jun. 1981.

M.F. O'Connor, K.E. Robbins, J.C. Williams: Redesigned 26–inch Last Stage fr Improved Turbine Reliability and Efficiency, Paper presented at the ASME/IEEE Joint Power Generation Conference, Sept. 17, 1984, Toronto, Ontario, Canada.

B.K. Sultanian, S. Nagao, T. Sakamoto: "Experimental and Three–Dimensional CFD Investigation in a Gas Turbine Exhaust System," Transactions ASME, Journal of Engineering for Gas Turbines and Power, vol. 121, pp. 364–374, Apr. 1999.

J.A. Owczarek, "Fundamentals of Gas Dynamics;" International Textbook Co., Scranton, PA 1964, pp. 200–201 of Text.

D.G. Wilson, "The Design of High–Efficiency Turbomachinery and Gas Turbines" MIT Press, Cambridge, Massachusetts 1984, Chapter 4, pp. 147–187.

Ihor S. Diakunchak, Mark P. Krush, Gerry McQuiggan, Leslie R. Southall: "The Siemens Westinghouse Advanced Turbine Systems Program" Presented at the International Gas Turbine & Aeroengine Congress in Jun. 1999 by The American Society of Mechanical Engineers.

A.J. Scalzo, R.L. Bannister, M. DeCorso, G.S. Howard: "Evolution of Westinghouse Heavy–Duty Power Generation and Industrial Combustion Turbines" Published in the Apr. 1996, vol. 118, Transactions of the ASME, Journal of Engineering for Gas Turbines and Power.

L. Southall, G. McQuiggan: "New 200 MW Combustion Turbine" also Pulbished in the Jul. 1996, vol. 118, Transactions of the ASME, Journal of Engineering for Gas Turbines and Power.

* cited by examiner

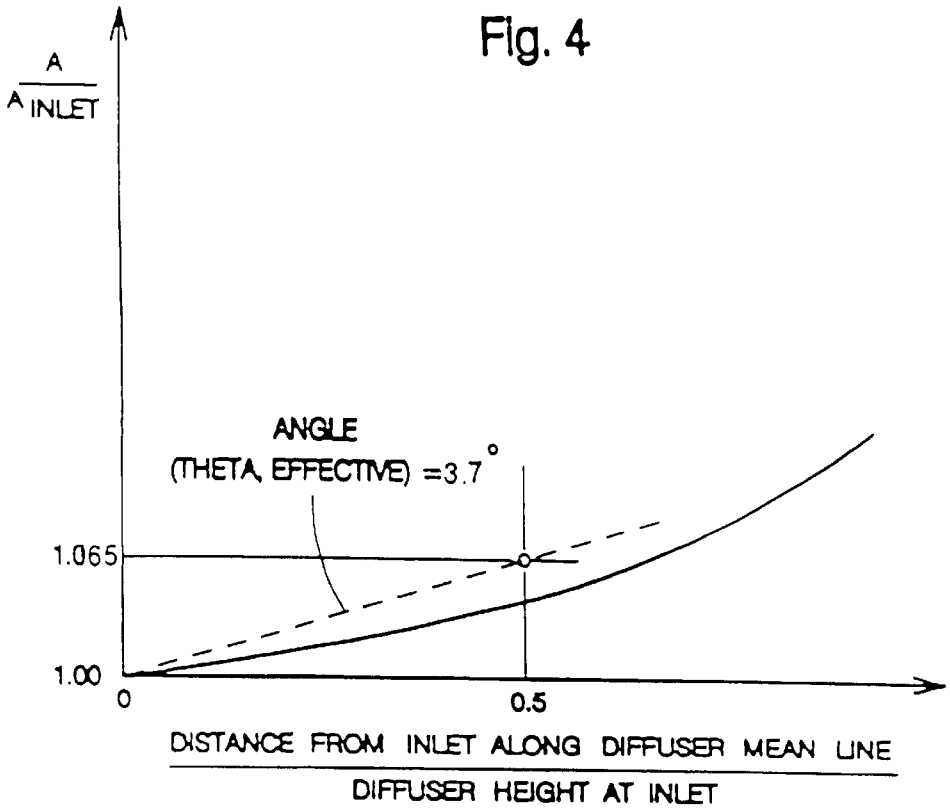
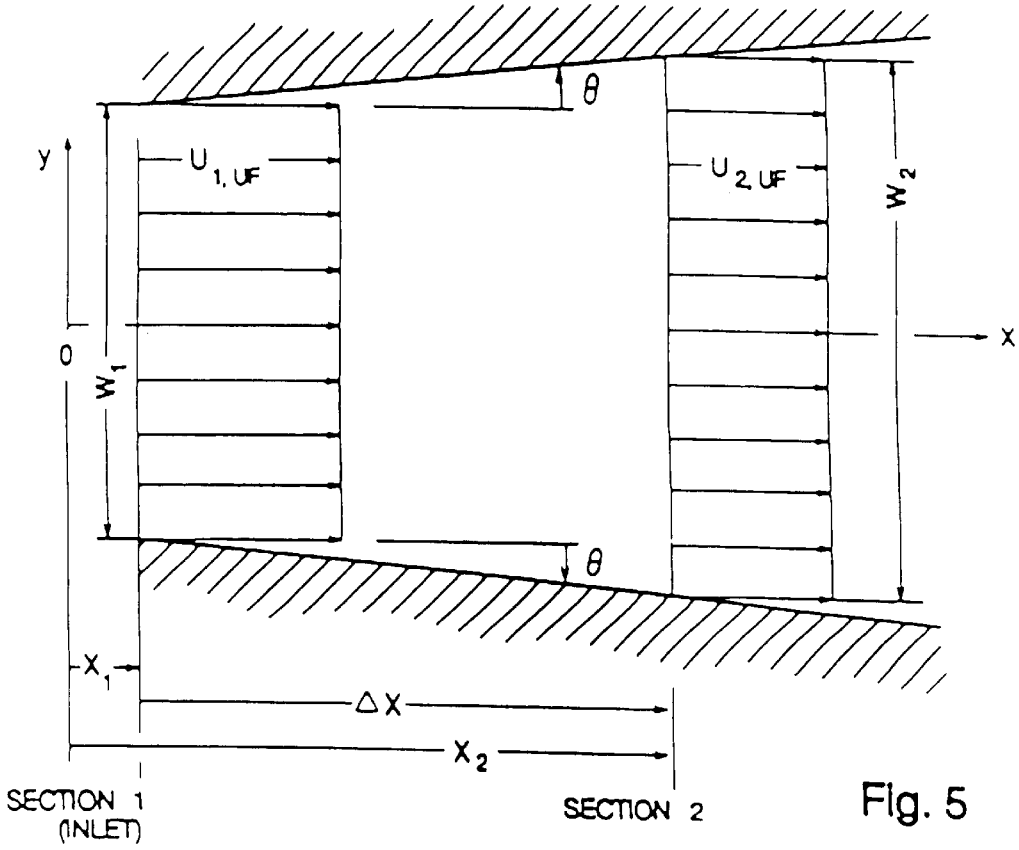
Fig. 5

ANNULAR FLOW DIFFUSERS FOR GAS TURBINES

RELATION TO OTHER APPLICATIONS

This application is a continuation-in-part of U.S. application 09/366,478 filed Aug. 3, 1999 by the present inventor and now U.S. Pat. No. 6,261,055.

BACKGROUND OF THE INVENTION

1. Field of the Invention

This invention relates to gas turbine units, or gas turbine engines, and more particularly to annular diffusers in gas turbine units. More particularly still, this invention relates to annular diffusers located downstream of gas turbines in gas turbine units.

2. Description of the Prior Art

A gas turbine unit used in power generation usually comprises two shafts: a high pressure shaft of the gas generator portion and a low pressure shaft of the load portion to assure greater application flexibility. The gas generator portion of the gas turbine unit consists of a compressor, which in general is of the axial-flow type, and which is directly coupled to a high pressure turbine having usually one or more axial-flow stages. The load portion of the gas turbine unit has one or more low pressure axial flow turbine stages and is directly coupled to a load, which may be, for example, an electric power generator, a compressor or a fan, or a ship propulsion shaft.

In most gas turbine units air enters the compressor of the gas generator portion from which it flows to one or more combustion chambers. Subsequently, the products of combustion, or combustion gases, flow through the high pressure turbine of the gas generator portion which provides power needed by the compressor, the high pressure turbine being followed by an annular diffuser. From the high pressure turbine the combustion gases flow to the low pressure (or hot end) turbine which is also followed by an annular diffuser.

A diffuser designed for a gas exiting at subsonic speeds from the high-pressure and the low-pressure turbines of a gas turbine unit is a duct whose cross-sectional area increases with distance. A well-designed and well-operating diffuser located after a turbine produces lowering of pressure downstream of the turbine which results in an increase of energy available to the turbine to do work and, therefore, in an increase of the efficiency of the whole gas turbine unit. A diffuser produces lowering of pressure downstream of the turbine by diffusing, or slowing down the flowing gas so that a significant amount of the kinetic energy of the gas is converted into enthalpy with an accompanying increase of pressure.

Almost all tests on the pressure recovery, or performance, of diffusers reported in the literature were run with uniform flow at inlet to the diffusers and under incompressible flow conditions.

The main feature which differentiates the flows in diffusers located at the exit of turbines from the vast majority of diffuser flows is the presence of wakes at diffuser inlets. The wakes develop at the trailing edges of blades as a result of coalescence of low velocity boundary layer flows which form adjacent to blade surfaces. Such wakes can become very thick when flow separation from the blades takes place. The wakes which have the largest effect on diffuser performance come, in general, from the turbine blades located just upstream of the diffuser inlet. Other, weaker, wakes may also enter a diffuser, for example the traces of wakes produced by the stationary nozzles located upstream of the final blades. (A smaller number of wakes can also be produced by the flow straightening vanes sometimes placed ahead or upstream of diffusers not far from the diffuser inlet.) All these wakes enter the diffusers located downstream of the turbines where such wakes decay. The process of decay of wakes involves entrainment of the surrounding fluid into the wakes resulting in a decrease of its velocity, which decrease in velocity is accompanied by a pressure rise in the diffuser, or flow diffusion. Such pressure rise occurs in addition to the flow diffusion and pressure rise caused by the increase of the diffuser cross-sectional area. The decay of wakes thus produces a secondary diffusion in addition to the primary diffusion incident to increase of the diffuser cross-sectional area and is discussed in applicant's application Ser. No. 09/366,478 for patent filed Aug. 3, 1999 and entitled "Exhaust Flow Diffuser for a Steam Turbine," the disclosure of which is hereby incorporated by reference in the present application.

Until now, annular diffusers of gas turbines have been designed using results from performance tests on diffusers having uniform flow distribution at the inlet and in general for incompressible fluid flows, with the results corrected for the effect of compressibility of the fluid on the area ratio-pressure rise relationship. The correction for compressibility decreases the allowable rate at which the diffuser cross-sectional area can increase for optimal diffuser performance compared to that of an incompressible flow. (At the optimal performance conditions there is no permanent flow separation from the walls which would cause severe deterioration of diffuser performance.) What has not been recognized until now is the fact that the process of decay of wakes has a large effect on the allowable rate of increase of the diffuser area ratio. Permanent flow separation in a diffuser occurs when the (longitudinal) pressure gradient becomes too large. The decay of wakes produces flow diffusion with accompanying pressure rise, or pressure gradient, independently of the pressure gradient which is produced by the diffuser cross-sectional area increase and this secondary diffusion is additive to the primary diffusion incident to cross-sectional area increase. In order to keep the pressure gradient in a diffuser flow with wakes at the same magnitude that existed or exists in a uniform flow, the rate of increase of cross-sectional area of the diffuser has to be decreased correspondingly. This is true in the initial section of a diffuser in which most of the decay of wakes takes place. After the wakes have become almost completely dissipated, the rate of diffuser cross-sectional area increase should correspond to the optimal rate of increase determined for an incompressible uniform flow corrected for the effect of compressibility of the fluid.

OBJECTS OF THE INVENTION

The prime object of this invention is to maximize the amount of work or power delivered by a gas turbine unit operating at design and off-design conditions by lowering the pressure at the exit of the hot end and cold end turbines.

It is a further object of the invention to provide a diffuser which will not induce permanent flow separation from the walls which would increase pressure at the turbine exit and decrease the amount of power produced by the turbine.

It is still a further object of this invention to account for the effect of wakes naturally occurring in gases passing from turbines through diffusers on the diffusion process in the diffuser.

It is a still further object of the invention to provide a diffuser having parameters that will account for the compressibility of flowing gases as well as for the effect of wakes.

It is a still further object of the invention to provide a diffuser having a limit placed on the rate of increase of its cross-sectional area in the initial portion of the diffuser.

It is a still further object of the invention to limit the increase in the cross-sectional area of a diffuser in the initial portion of the diffuser extending to one half the diffuser inlet height to no more than 6.5 percent of the inlet cross-sectional area corresponding to a two-dimensional straight-wall diffuser angle of 3.7 degrees or less.

Additional objects and advantages of the present invention will become evident from review of the following specifications and appended drawings.

SUMMARY OF THE INVENTION

The process of decay of wakes inherent in the exhaust flow diffusers of turbines produces a certain amount of diffusion, and therefore also a pressure gradient, which adds to that which results from the increase of the diffuser cross-sectional area. In order to keep the magnitude of the pressure gradient the same as in the case of a flow having uniform inlet conditions (without wakes) with an optimal amount of diffusion so as to avoid permanent flow separation from diffuser walls, the rate of increase of diffuser cross-sectional area must be correspondingly smaller.

To allow for the presence of wakes at the diffuser inlet, a limit is placed on the initial rate of increase of diffuser cross-sectional area. In the diffuser of this invention the initial increase of the cross-sectional area of the diffuser is limited to less than a predetermined fraction of the inlet cross-sectional area for a certain distance from the inlet. In accordance with this invention the area increase in the diffuser cross-section from the inlet to a distance downstream from the inlet of one half of the diffuser height at inlet, measured along the diffuser mean line, is limited to no more than 6.5 percent of the inlet cross-sectional area. This represents a value of the corresponding angle of a two-dimensional straight-wall diffuser of 3.7 degrees. By limiting the increase in cross-sectional area of the diffuser to such percentage increase in the initial portion of the diffuser as defined, the wakes are allowed to substantially dissipate without producing flow separation from diffuser walls after which the cross-sectional area of the diffuser may be increased at a higher rate consistent with a separation-free flow and corresponding mainly to the optimal rate determined for an incompressible and uniform flow corrected for the effect of compressibility of the fluid.

BRIEF DESCRIPTION OF THE DRAWINGS

The nature of this invention will become clearer by reference to the following description, appended claims, and the views illustrated in the accompanying drawings in which:

FIG. 4 is a graph showing for a diffuser of this invention a typical variation of the ratio of diffuser cross-sectional area with dimension-less distance from diffuser inlet measured along the diffuser mean line.

FIG. 5 is a sketch of a two-dimensional straight-wall diffuser with uniform flow used in the Appendix in the derivation of the design criterion which restricts the initial rate of increase of diffuser cross-sectional area so as to prevent separation of flow in diffusers of gas turbines.

DETAILED DESCRIPTION OF THE INVENTION

Figure 1:
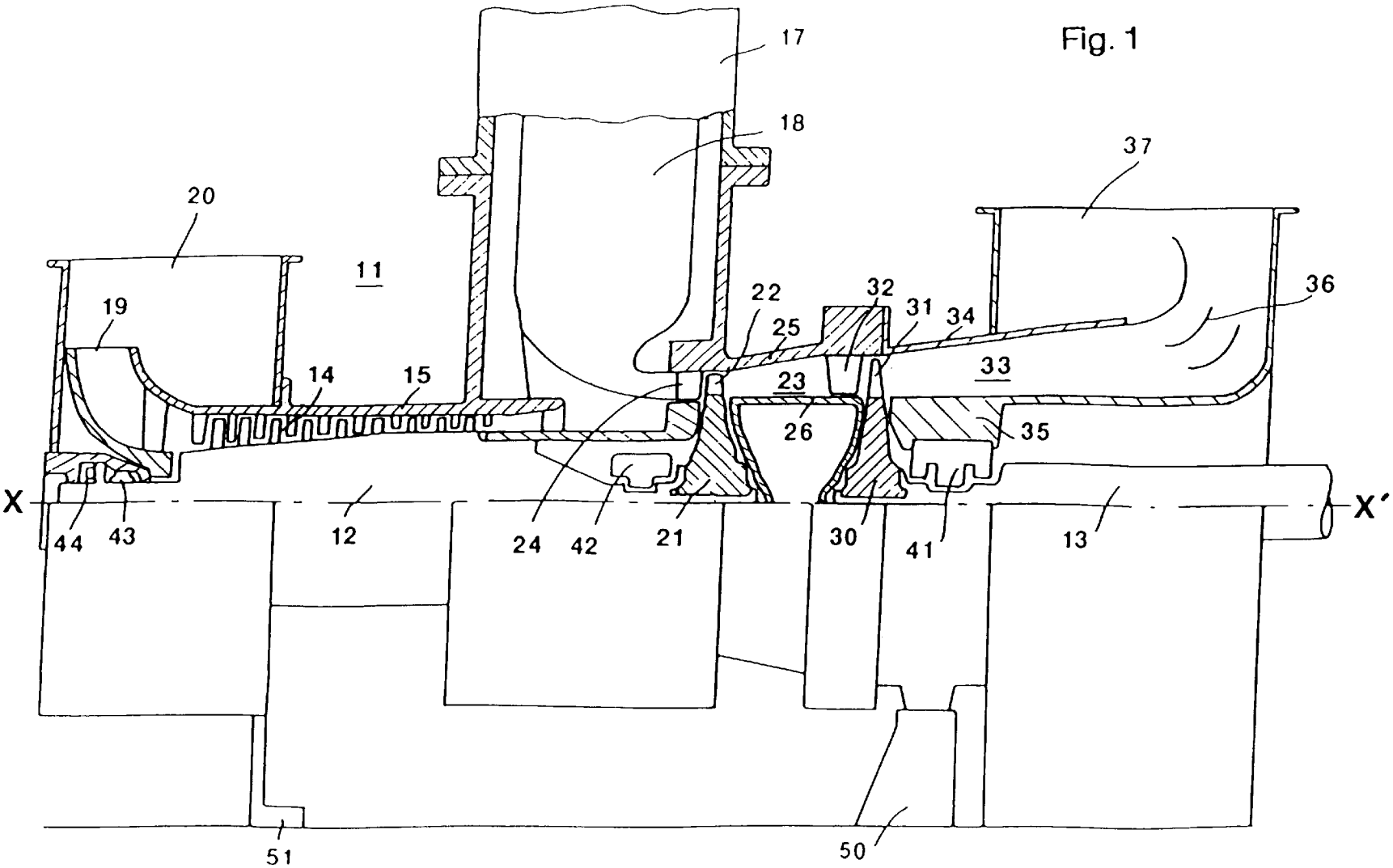
FIG. 1 is a schematic, longitudinal sectional view of the upper part of a two-shaft gas turbine unit used in power generation showing the high-pressure portion of the unit, the load, or low-pressure, portion of the unit, and the combustion chamber.

This invention, as described above, relates to an annular diffuser, which is an annular flow passage whose cross-sectional area, for subsonic flow, increases with distance from the inlet and whose purpose is to produce diffusion in a flowing fluid, or more particularly in a gas, i.e. to produce an increase of pressure and decrease of flow velocity from inlet to exit of such diffuser. With the diffuser inlet located just downstream of the turbine blades, the diffuser produces a lowering of gas pressure at the exit of the turbine blades and thus increases the energy available for the turbine to do work and therefore also turbine efficiency.

The annular diffusers of gas turbines are presently being designed using the test information on the geometries required for optimal performance obtained on annular diffusers having a uniform and, in general, incompressible flow at the inlet. The optimal performance of a diffuser occurs when the cross-sectional area increases at a rate which is somewhat smaller than that at which permanent flow separation from diffuser walls takes place. Flow separation causes the pressure recovery in the diffuser to markedly decrease or even to be eliminated. Flow separation from the walls of a diffuser occurs when the pressure gradient in the diffuser, or the rate of increase of pressure with distance, becomes too large. The pressure rise in a diffuser having a uniform inlet flow occurs as a direct result of cross-sectional area increase.

The performance of an annular diffuser located at the exit of a turbine is affected very significantly by the presence of wakes. The wakes develop at the trailing edges of blades as a result of coalescence of low velocity boundary layer flows which form adjacent to blade surfaces. They can become quite thick when flow separation from the blades takes place. Such flow separation from blades can be caused by a large angle of incidence of the flow on the blades resulting from a decrease of the flow rate through the turbine below the design value at partial loads. The pressure gradient in the diffuser, whose magnitude must be kept below a certain value to avoid flow separation from the walls, is generated not only by the increase of the diffuser cross-sectional area, but also by the flow diffusion produced by the decay of the wakes. In order to avoid flow separation from diffuser walls, and therefore to keep the pressure gradient in the diffuser below the value which would cause flow separation, the rate of increase of the diffuser cross-sectional area has to be decreased relative to that corresponding to a uniform inlet flow. This must be done to compensate for the diffusion, and therefore also pressure gradient, produced by the decay of wakes. In addition, the effect of compressibility of the flowing gas on the relationship between the rate of increase of diffuser cross-sectional area and the resulting pressure rise must be accounted for.

At gas turbine operating conditions different from those used in the design of the turbine, that is, at off-design conditions such as occur when operating at partial power and flow rate, the flow Mach number at the inlet to the diffusers located downstream of the high-pressure and the low-pressure turbines becomes smaller. In such case, unless variable, or adjustable, nozzles are used, as a result of creation of a large incidence angle of flow at the inlet of turbine blades or upon the blade surfaces, flow separation from the blades takes place and the wakes which enter the diffusers are very thick. The process of decay of such wakes is responsible for generation of a large amount of flow diffusion (secondary diffusion) and pressure gradient in the initial portion of a diffuser in which the wakes are decaying which adds to that produced by the increase of the diffuser cross-sectional area. In order to keep the magnitude of the pressure gradient in the diffuser at the same level as in the case of a flow with a uniform inlet velocity, that is, in a flow without wakes in it, having an optimal amount of diffusion, or an optimal pressure gradient, so as to avoid flow separation from diffuser walls, the initial rate of increase of diffuser cross-sectional area in a flow with wakes must be correspondingly smaller. (This area decrease has to be in addition to that required by the correction to the area ratio-pressure rise relationship caused by compressibility of the fluid to the results obtained for an incompressible flow.)

At gas turbine design operating conditions, when no flow separation should be expected from well-designed turbine blades, the wakes entering the diffuser are much thinner than at the off-design operating conditions. In such case the reduction of the normal diffuser cross-sectional area increase at inlet required as a result of wakes is smaller. However, at design conditions the diffuser inlet flow Mach number is usually larger than at off-design conditions which requires a greater decrease of the normal cross-sectional area increase relative to the incompressible uniform flow.

By area ratio at a particular location in a diffuser, it is meant the ratio of the diffuser cross-sectional area at that location to the diffuser cross-sectional area at the inlet to the diffuser. These areas are determined at the equi-potential lines, one drawn at the location in question and one at the diffuser inlet usually beginning at the bearing or shaft cover end adjacent to the turbine wheel, for the diffuser cross section in a corresponding radial plane passing through the turbine axis. The equi-potential lines refer to lines perpendicular at all points to flow lines or streamlines passing through a diffuser or the like. The particular location in the diffuser at which the area ratio is being determined is to be defined at the diffuser mean line at the given cross section. By diffuser mean line, as the term is used herein, is meant the line connecting the mid-points of the equi-potential lines drawn for the diffuser radial cross-section being considered, extending from the inlet equi-potential line to the exit equi-potential line. By exit-to-inlet area ratio of a diffuser at a particular circumferential location, it is meant the ratio of the exit area to the inlet area determined in a radial plane passing through the turbine axis. The length of a diffuser, at a given circumferential location, corresponds herein to the length of the mean line at that location.

The equi-potential lines in a diffuser having a slowly increasing cross-sectional area with distance along the mean line have large radii of curvature, that is they are relatively flat. As long as the equi-potential lines deviate little from straight lines, the exit-to-inlet area ratio of a diffuser at some circumferential location can be determined with reasonable accuracy by dividing the products of the lengths of the equi-potential lines and of the radii drawn perpendicularly from the turbine axis to the mid-points of the equi-potential lines for the exit and inlet of the diffuser. A similar procedure can be used to determine area ratio for a location within the diffuser different than the exit.

The corresponding two-dimensional straight-wall diffuser angle $\theta_{EFFECTIVE}$ or $\theta_{EFF}$ for a location in an annular diffuser some distance away from the inlet measured along the diffuser mean line is defined by equation:

$$\text{area ratio } (AR)_{\Delta x}=1+2(\Delta x/h_1)\tan\theta_{EFF}$$

where the area ratio $(AR)_{\Delta x}$ denotes the ratio of the diffuser cross-sectional area at the location at a distance "$\Delta x$" from the inlet being considered to the cross-sectional area at inlet. Symbol $h_1$ denotes the annular diffuser height at inlet and corresponds to the length of the equi-potential line at inlet; in general, it is slightly larger than the height of the turbine final blades near diffuser inlet.

Test results reported by G. Sovran and E. D. Klomp in an article: "Experimentally Determined Optimum Geometries for Rectilinear Diffusers with Rectangular, Conical or Annular Cross Section" in Fluid Mechanics of Internal Flow, Elsevier Publishing Company, Amsterdam, Netherlands in 1967, and test results reported in "Steam Turbines for Large Power Outputs," von Karman Institute for Fluid Dynamics, Lecture Series 1980–6, Rhode Saint Genese, Belgium in 1980 show that in annular diffusers having straight axes and uniform incompressible flow at inlet at high Reynolds numbers and small inlet area blockage by the boundary layers the optimal performance at a distance of $\Delta x=0.5\ h_1$ from inlet, or in diffusers of that length, occurs when the ratio of the cross-sectional area at that location to the inlet area $A/A_1$ is 1.10, that is, the optimal cross-sectional area increase is $(\Delta A/A_1)=0.10$. Such diffuser geometry results in the largest pressure gradient which the boundary layer in the diffuser can sustain in the inlet region (that is, for a distance of $\Delta x=0.5\ h_1$) for a uniform and incompressible flow without permanent flow separation from the walls. According to extrapolated results of Sovran and Klomp, the corresponding diffusion coefficient, known also as the pressure recovery coefficient, has a value somewhere between 0.1 and 0.2. From the equation given above, it follows that the optimal corresponding two-dimensional straight-wall diffuser angle $\theta_{EFF}$ is 5.71 degrees.

The annular diffusers of the present invention should have their cross-sectional areas increase initially very slowly with distance along the diffuser mean line to allow wakes in the flow to dissipate significantly before the cross-sectional area can begin to increase at a higher rate. This is so because, if a larger increase of cross-sectional area is attempted when the wakes are still deep and thick, the overall diffusion and therefore also the pressure gradient will become too large and permanent flow separation from the walls, or stall, will occur.

It is the intent of this invention, therefore, to provide an upper limit to the allowable corresponding two-dimensional straight-wall diffuser angle for an annular diffuser in the region near to the inlet when the incoming flow has in it wakes coming from turbine moving or stationary blades and allowing for the effect of compressibility of the flowing gas. At a distance of one half of diffuser height at inlet measured along the diffuser mean line from its inlet the corresponding two-dimensional straight-wall diffuser angle should be no more than 3.7 degrees, which corresponds to a 6.5 percent increase of cross-sectional area over the inlet area.

The present inventor, therefore, has determined, (by the analysis presented in the Appendix), that contrary to the prevailing practice and understanding as evidenced by the available literature references, the rate of increase of cross-sectional area in the initial portion of a diffuser which follows a turbine must be decreased to account for the diffusion, and therefore the pressure gradient, which is generated in such diffusers by the decay of the wakes inherent in such diffusers. To compensate for the effect of the wakes the increase of the cross-sectional area in the diffuser at a distance of one half of the diffuser inlet height should be no greater than 6.5 percent of the cross-sectional area of the diffuser at its inlet which represents a corresponding two-dimensional straight-wall diffuser angle of 3.7 degrees. Thereafter i.e. after a distance of one half of the diffuser height at inlet, the corresponding two-dimensional straight-wall diffuser angle can be acceptably higher over the remaining length of the diffuser.

In FIG. 1 there is shown a longitudinal cross-sectional view of the upper part of a typical two-shaft gas turbine unit used in power generation indicated generally as 11. Gas turbine unit 11 is made up of two portions: a so-called gas generator portion and a load portion and has two rotors. One rotor, rotor 12 of the gas generator portion is often referred to as the high-pressure rotor. The other rotor, rotor 13 of the load portion is also referred to as the low-pressure rotor or the load rotor. The rotors, or rotating shafts, have central longitudinal axis X–X'. Air enters the gas turbine unit at air inlet hood 20, and combustion gases leave it through exhaust hood 37. Rotor 12 has mounted, or attached to it, an axial-flow compressor 14 composed of stator vanes and rotor blades and enclosed by casing 15. Air, which enters the gas turbine unit through the air inlet hood 20 and air inlet duct 19 to the compressor 14 flows from the compressor to combustion chamber 17 having inner liner 18. Combustion gases flow from the combustion chamber 17 to high-pressure turbine of the gas generator portion having wheel 21, inlet nozzles 24, and blades 22. Following the high-pressure turbine is high-pressure annular diffuser 23 whose outer walls are made up of the high-pressure turbine outer casing 25 and the inner, cylindrical, shaft cover wall 26. From the high-pressure diffuser 23 combustion gases flow to the low-pressure turbine of the load portion having wheel 30, adjustable inlet nozzles 32, and blades 31. The low pressure turbine is followed by low-pressure annular diffuser 33 whose outer wall is made up of a conical casing 34 and a cylindrical inner wall and bearing cover 35. At the end of diffuser 33 are located turning vanes 36 whose purpose is to direct the flow of the exhaust gases to the exhaust hood 37.

The load rotor 13 is supported by a bearing having housing 41, and the gas generator rotor is supported by bearings 42 and 43. At the front end of the gas generator rotor is thrust bearing 44. The gas turbine unit is supported on pedestal 50 and support 51.

Figure 2:
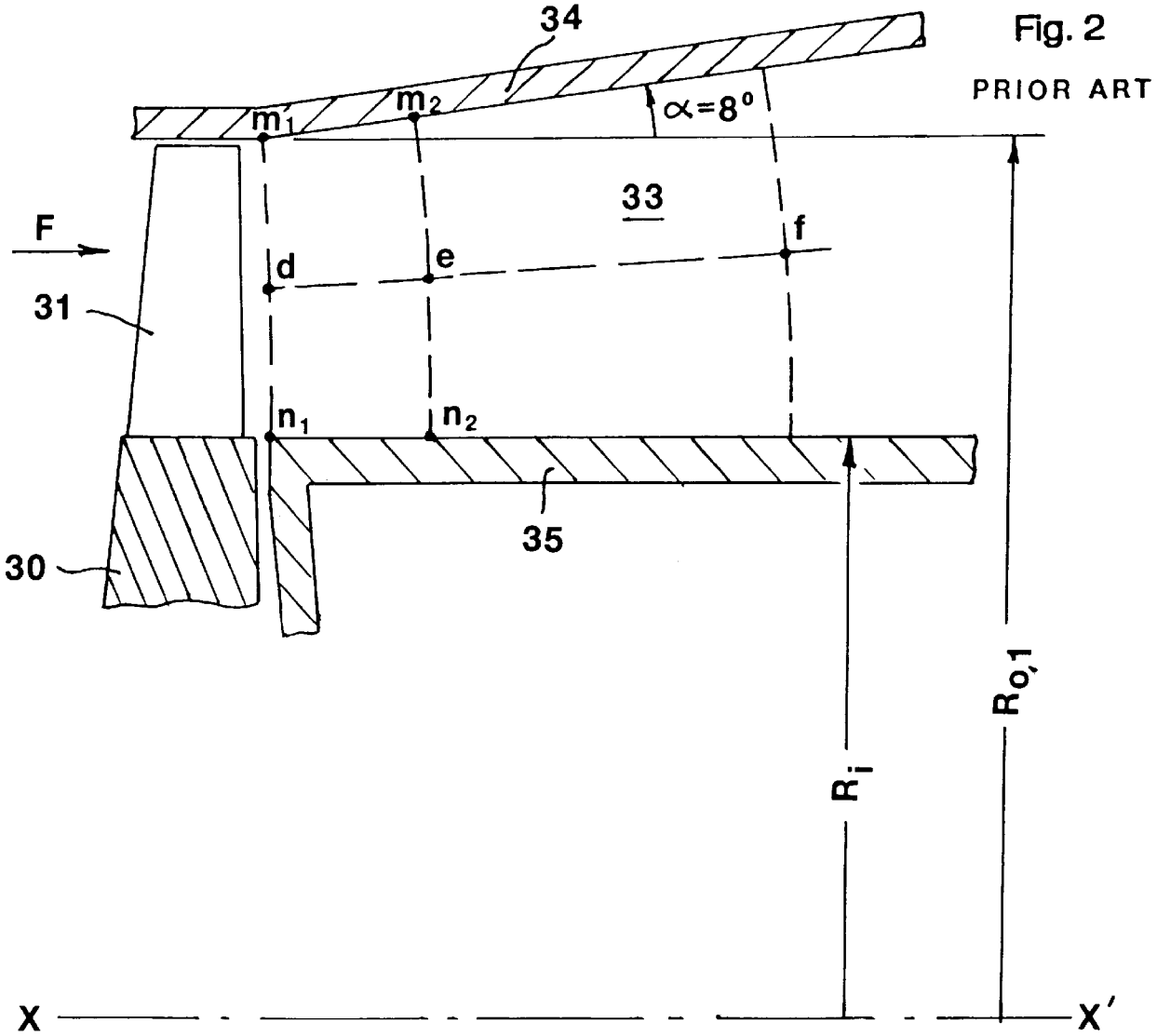
Fig. 2 PRIOR ART
FIG. 2 is a sketch of a cross section of a typical straight-core annular diffuser in a gas turbine of prior art showing a turbine wheel and a blade attached to it together with the diffuser whose mean line and the three equi-potential lines are indicated and whose outer wall is inclined at an angle of 8 degrees to the turbine axial direction. The first equi-potential line is drawn at the inlet to the diffuser, and the second equi-potential line is drawn at a distance from inlet of one half of the diffuser inlet height. The diffuser inlet height corresponds to the length of the first equi-potential line. The third equi-potential line is drawn at some arbitrary distance from diffuser inlet.

In FIG. 2 there is shown an example of the low-pressure turbine straight-core annular diffuser 33 of the prior art formed by the outer casing 34 and inner cylindrical wall 35. Upstream of diffuser 33 is the low-pressure turbine of the load portion with wheel 30 and blade 31 of the turbine being shown. The central longitudinal axis of the gas turbine rotors X–X' is also shown. Indicated in FIG. 2 are the inner inlet radius to the diffuser $R_i$ and the outer inlet radius to the diffuser $R_{o,1}$. Also shown are the initial equi-potential line $n_2$ $m_2$ defining the diffuser inlet and its height, the equi-potential line $n_2$ $m_2$ defining the diffuser section located at a distance of $\Delta x=0.5\ h_1$ from diffuser inlet with the distance d–e being equal to the distances $n_1$–d and d–$m_1$, and a third equi-potential line not marked by letters at some arbitrary distance from diffuser inlet. The mid-points d, e, and f of the equi-potential lines define the diffuser mean line d-e-f of the diffuser. The diffuser shown has the radius ratio at inlet $R_i/R_{o,1}=0.66$ and the outer wall angle $\alpha$ of 8 degrees with respect to horizontal. The ratio of the diffuser cross-sectional area at $\Delta x=0.5\ h_1$ to the inlet area is 1.085, for which the corresponding two-dimensional straight-wall diffuser angle $\theta_{EFF}=4.9$ degrees.

Figure 3:
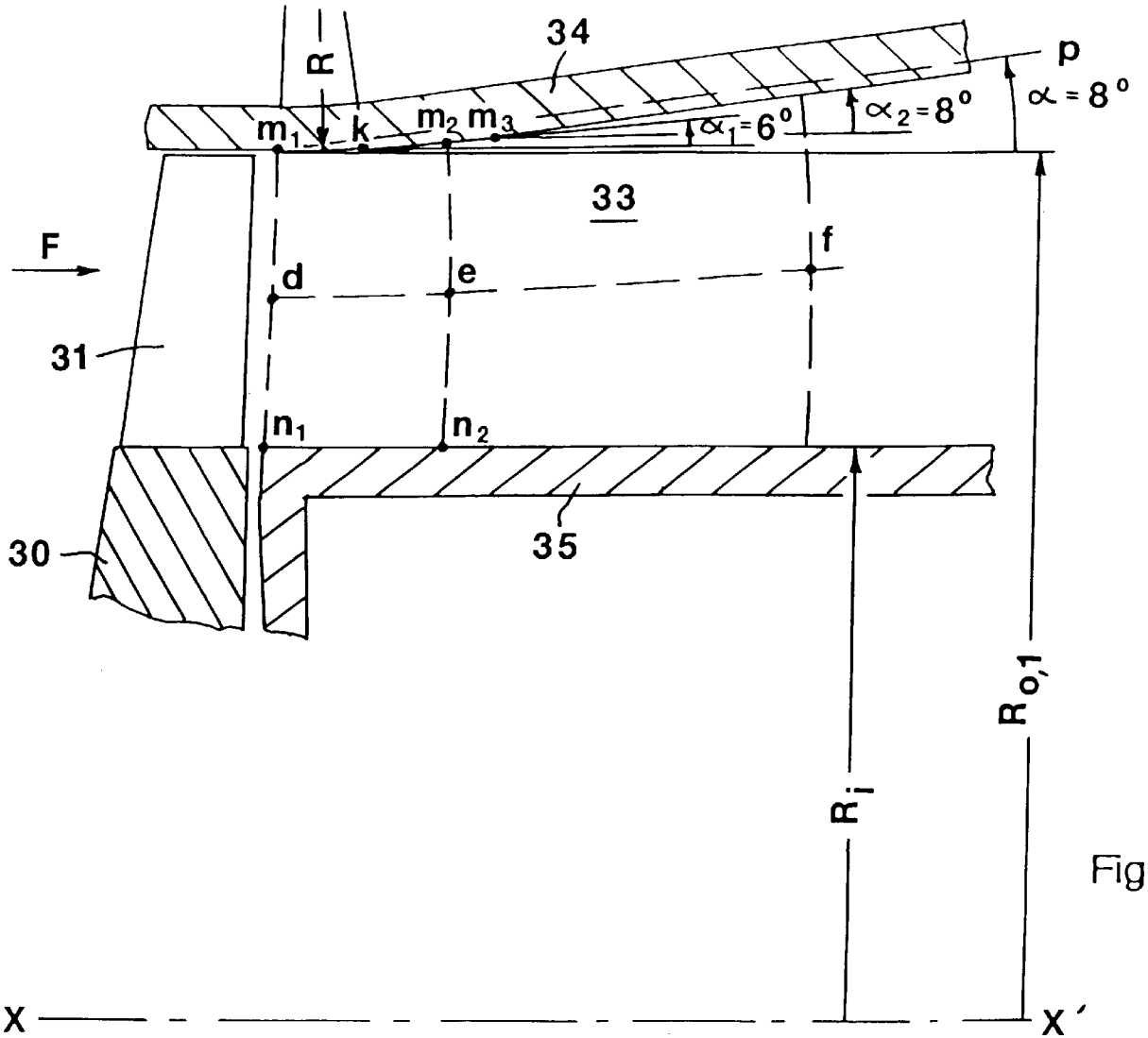
FIG. 3 is a sketch of the diffuser shown in FIG. 2 modified according to this invention. The angle of the outer wall is inclined at an angle of 6 degrees to the turbine axial direction for most of the distance of one half of the diffuser inlet height from inlet and at an angle of 8 degrees at larger distances with smooth transitions of the direction of the outer wall occurring at diffuser inlet, at the location where the outer wall inclined at 6 degrees begins, and at the location where the change of the wall angle from 6 to 8 degrees takes place.

FIG. 3 shows an example of the preferred embodiment of the low-pressure turbine straight-core annular diffuser 33 of this invention having outer casing 34 and inner wall 35. Also shown is the wheel 30 of the low-pressure turbine of the load section and blade 31 attached to it. Illustrated are the equi-potential line $n_1$ $m_1$ defining the diffuser inlet and its height, the equi-potential line $n_2$ $m_2$ defining the diffuser cross-section located at a distance of $\Delta x=0.5\ h_1$ from diffuser inlet measured along the mean line, an unmarked equi-potential line and diffuser mean line d-e-f. It has the same radius ratio $R_i/R_{o,1}=0.66$ as the example diffuser of the prior art shown in FIG. 2, but its outer wall has a horizontal tangent at diffuser inlet (point "$m_1$"), and it merges smoothly in a transition section $m_1$–k having radius of curvature R with a wall inclined at angle $\alpha_1=6$ degrees to horizontal at point "k." At some point "$m_3$" on the equi-potential line located at a distance of $\Delta x>0.5\ h_1$ from diffuser inlet measured along the diffuser mean line, not shown, the outer wall angle changes smoothly to angle $\alpha_2=8$ degrees to horizontal. Broken line $m_1$–p represents the outer wall of the prior art diffuser shown in FIG. 2.

The diffuser of this invention shown in FIG. 3 has a ratio of cross-sectional area at a distance of $\Delta x=0.5\ h_1$ to the inlet area of 1.06 and the corresponding two-dimensional straight-wall diffuser angle of 3.4 degrees.

FIG. 4 shows a typical variation of cross-sectional area with distance from inlet of the diffuser measured along the diffuser mean line of a diffuser of this invention. The abscissa designates a dimension-less distance from the inlet of the diffuser along the mean line of the diffuser and the ordinate represents the area ratio of the diffuser at any point along the abscissa. A (inlet) refers to the diffuser cross-sectional area at inlet, determined at the first equi-potential line for the diffuser. Diffuser inlet height at inlet is defined herein as the length of the first equi-potential line at inlet, which for the examples illustrated in FIGS. 1 and 2 is drawn from the inner wall and bearing cover designated as 35 in FIG. 1, FIG. 2 and in FIG. 3. At a dimension-less distance from inlet measured along a mean line of 0.5 the diffuser cross-sectional area increase from inlet is less than 6.5 percent, the ratio A/A (inlet) being less than 1.065, and the corresponding two-dimensional straight-wall diffuser angle is smaller than 3.7 degrees. At a distance larger than one half of diffuser height at inlet the diffuser cross-sectional area ratio can increase at rates which are acceptably higher than at smaller distances.

FIG. 5 is a sketch of a two-dimensional straight-wall diffuser with a uniform flow. The velocities at section 1 at inlet and at section 2 at a distance of Δx from inlet are shown. Also indicated is the nomenclature needed to describe the flow model and the diffuser used in the analysis presented in the Appendix.

Figure 6:
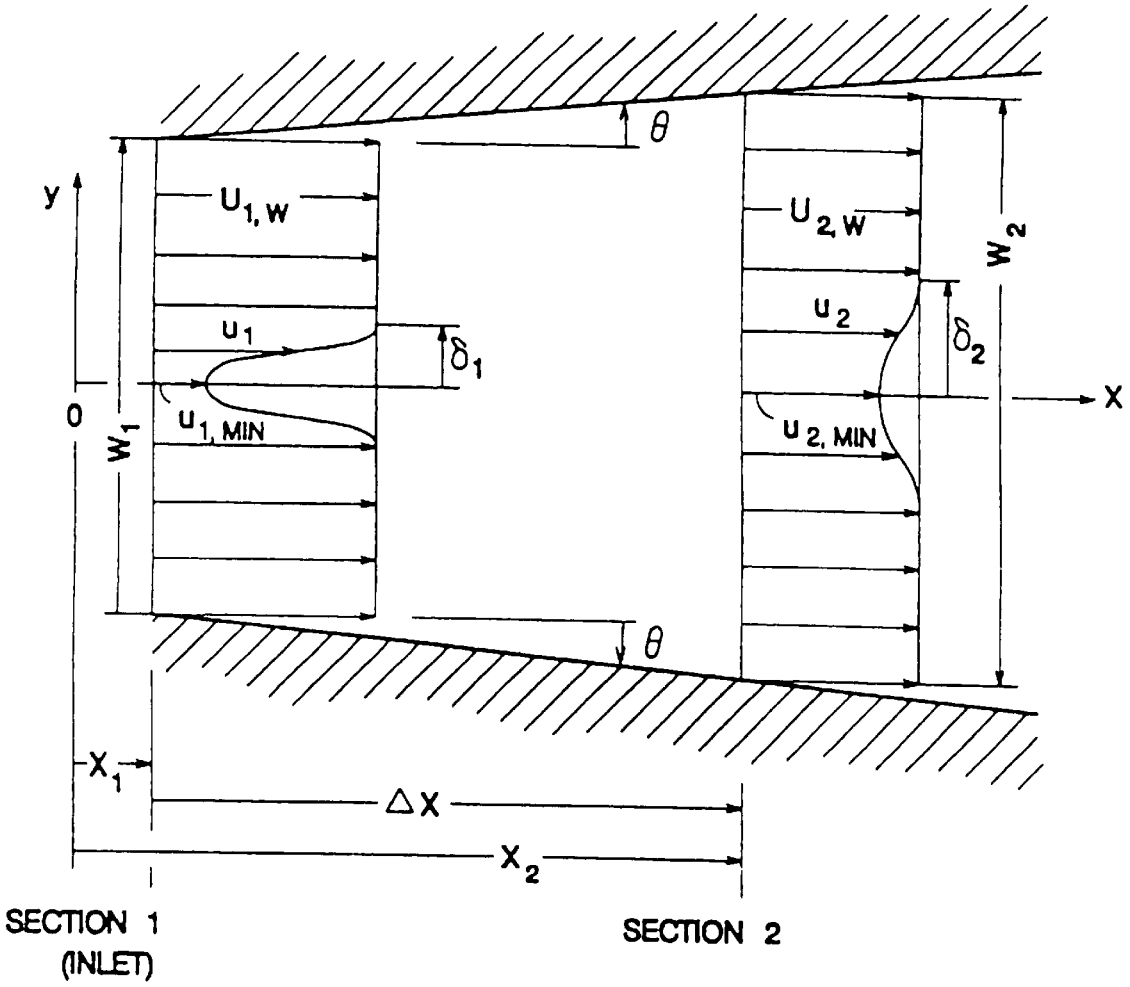
FIG. 6 is a sketch of a two-dimensional straight-wall diffuser corresponding to the one shown in FIG. 5 but with a wake at inlet used in the derivation of the design criterion in the Appendix.

FIG. 6 shows a sketch of a two-dimensional straight-wall diffuser like the one shown in FIG. 5 but with the flow containing wakes in it. Although there are N wakes in the diffuser, only one is shown to allow clear description of the wakes. The nomenclature needed to describe the diffuser and the flow model used is given.

There is appended hereinafter at the conclusion of the description herewith an Appendix providing the details of the inventor's physical and mathematical modeling and of the theoretical analysis on which the present invention is based.

The results of such modeling clearly show the fact not previously generally recognized that the wakes unavoidably present in a diffuser used immediately after a gas or vapor turbine or immediately after a row of stationary vanes, or blades, have an effect on the diffusion process in a diffuser similar to that of a diffuser cross-sectional area increase. This is so because the wakes initially represent space in the diffuser with very small flow rate through it around which space the faster flowing fluid outside the wakes passes. As a result of viscous interaction between the fluid in the wakes and the surrounding higher velocity fluid, entrainment of the surrounding fluid into the wakes takes place, with a resulting flow velocity increase in the wakes. (The wakes spread as a result of viscous interaction with the outside fluid, while their depth decreases.) Thus in effect the decaying wakes in a diffuser provide additional area available for the outside fluid to fill.

And so the decay of wakes caused by viscous interaction between the fluid streams reduces the velocity of the main stream and produces simultaneously an increase of pressure in the diffuser. This pressure increase, which can be referred to as secondary diffusion, is additive to the primary pressure increase caused by increasing cross-sectional area of the diffuser. Too rapid an increase in pressure in a diffuser beyond a fairly well established limit will cause fluid flow separation from the wall or walls of the diffuser. The effect of wakes in such flow should be allowed for in limiting the expansion along the diffuser in order to allow efficient operation of the diffuser. Because of this additive relationship between the pressure rise caused by the decay of wakes and by the increase of diffuser's cross-sectional area, the present applicant has found that the rate of increase in cross-sectional area of the diffuser should, in order to avoid flow separation from the walls of the diffuser, be limited in the first portion of the diffuser to provide an opportunity for the wakes to largely decay or dissipate with a concomitant increase of fluid pressure before normal increase in cross-sectional area of the diffuser is allowed.

The present inventor has determined by the analysis made in the appended Appendix that to account for the effect of decay of wakes and of compressibility of flowing gas the cross-sectional area increase in the initial portion of the diffuser extending to a distance of one half of the height of the diffuser at the inlet should be restricted to no more than 6.5 percent of the cross-sectional area at inlet or that the corresponding two-dimensional straight-wall diffuser angle be limited to approximately 3.7 degrees. The diffuser walls should also preferably have horizontal tangents at the diffuser inlet.

The gas turbine annular flow diffuser of this invention has been described in a preferred manner for the low-pressure turbine, but the invention is applicable also to other annular flow diffusers of the gas turbine unit such as, for example, the diffuser of the high-pressure turbine. In addition, it has been described without considering diffusers whose shapes may be non-uniform around the circumference of the turbine. Although the shapes of such diffusers may differ from the simple, circumferentially uniform, shape described, and their cross-sectional areas may vary around the circumference of the turbine, such diffusers are subject to the same restriction on their initial rate of increase of cross-sectional areas as the diffusers described herein. It is recognized that modifications and variations can be made by those skilled in the art to the above described invention without departing from the spirit and scope thereof as defined in the appended claims.

While the present invention, therefore, has been described at some length and with some particularity with respect to one particular embodiment, it is not intended that it should be limited to any such particulars or any such particular embodiments, but is to be construed with reference to the appended claims so as to provide the broadest possible interpretation of such claims in view of the prior art, and therefore, to effectively encompass the intended scope of the invention.

Appendix

Analysis Leading to the Design Criterion which Restricts the Initial Rate of Increase of Diffuser Cross-Sectional Area so as to Prevent Seperation of Flow in Diffusers of Gas Turbines

Introduction

The object of this analysis is to obtain a design criterion which sets a limit on the rate of increase of the cross-sectional area of the initial portion of flow diffusers of gas turbines so that diffusion of flow can take place at or near optimal performance and flow separation from diffuser walls can be avoided for given operating conditions characterized by the inlet flow Mach number to the diffuser. The limit placed on this rate of increase of diffuser cross-sectional area is more restrictive than the generally used limiting rate of increase corresponding to a uniform flow at the inlet. It takes into account the effect of wakes present at diffuser inlet and of compressibility of the flowing gas. The restriction on the rate of increase of the diffuser cross-sectional area will be limited to a distance from diffuser inlet, Δx, of one half of the diffuser height at inlet, $h_1$, because it is the region near the inlet to a diffuser that is affected most by the wakes (and, incidentally, also by the compressibility of the flowing fluid).

A diffuser for a subsonic flow is a duct whose cross-sectional area in general increases with distance and whose purpose is to diffuse, or to slow down, the flowing fluid so that a large fraction of its kinetic energy is converted into enthalpy with the accompanying increase of fluid pressure. The purpose of a diffuser of a gas turbine is to produce lowering of pressure downstream of the turbine which results in an increase of the energy available to the turbine to do work and, therefore, in an increase of its efficiency.

The main feature characteristic of flows in diffusers located at the exit of turbines which makes these flows so much different from the vast majority of diffuser flows is the presence of wakes at diffuser inlets. The wakes develop at the trailing edges of blades as a result of coalescence of boundary layers which form adjacent to blade surfaces. They can become quite thick when flow separation from the blades takes place. The wakes which have largest effect on diffuser performance in general come from the turbine blades located just upstream of the diffuser inlet. Other, weaker, wakes may also enter a diffuser, for example the traces of wakes left over from the wakes produced by stationary nozzles located upstream of the last blades. Wakes can also be created by flow straightening vanes sometimes placed at the turbine exhaust not far from the diffuser inlet. All these wakes enter the exhaust flow diffusers where they decay. The process of decay of wakes results in a decrease of velocity of the main stream which is accompanied by a pressure rise in the diffuser, or flow diffusion. This pressure rise occurs in addition to the pressure rise, or flow diffusion, caused by the increase of the diffuser cross-sectional area. In the analysis which follows we will consider only the wakes coming from the turbine blades located just upstream of the diffuser inlet.

The rate of increase of the cross-sectional area of a diffuser, and the rate of decrease of the flow velocity and the rate of increase of pressure which results from it, are limited by the allowable pressure gradient within the diffuser. If the pressure gradient is too large then the boundary layer flow will separate from diffuser walls and little if any diffusion will take place.

Tests on diffusers have in the past been performed mostly with flows utilizing water or air at low flow Mach numbers which are referred to as incompressible flows. They have provided information on the rates of increase of the cross-sectional areas which diffusers of various shapes should have for a uniform inlet flow in order to achieve optimal performance, that is, to achieve the highest amount of diffusion, or pressure rise, and to avoid appearance of permanent flow separation from the walls which seriously reduces the amount of diffusion and can even eliminate it entirely.

The performance of an annular diffuser of a turbine is affected very significantly by the presence of wakes. This is so because the pressure gradient in the diffuser is created not only by the increase of the diffuser cross-sectional area but also by the flow diffusion caused by the process of decay of the wakes. in order to avoid separation of flow from diffuser walls, and therefore to keep the pressure gradient in the diffuser below a certain magnitude, the rate of increase of the diffuser cross-sectional area has to be decreased relative to that corresponding to uniform inlet flow in order to compensate for the diffusion, and therefore also for the pressure gradient, produced by the decay of wakes. In addition, an analysis whose goal is to determine the optimal geometry of a diffuser, must take into account the effect of compressibility of the flowing fluid on the relationship between the rate of increase of diffuser cross-sectional area and the resulting pressure rise.

The analysis whose object is to obtain an estimate of the effect of decay of wakes on the optimal rate of increase of the cross-sectional area of an annular diffuser is made for a two-dimensional straight-wall diffuser with an incompressible flow having a wall angle equal to the corresponding optimal angle of an annular diffuser. Subsequently, compressibility of the flowing fluid is accounted for. The effect of the relatively thin boundary layers at the walls on the velocity profile at a given cross section in the diffuser will be disregarded.

FIG. 5 shows a drawing of a two-dimensional small wall angle diffuser of unit height with a uniform flow and explains the meaning of the terms used in the analysis.

The equation for a two-dimensional straight-wall diffuser relating the ratio of cross-sectional area A at a distance $\Delta x$ away from the inlet and the inlet cross-sectional area $A_1$, or the diffuser widths W and $W_1$, to the diffuser angle $\theta$ can be written as:

$$\frac{A}{A_1} = \frac{W}{W_1} = 1 + 2\left(\frac{\Delta x}{W_1}\right)\tan\theta \tag{1}$$

with the subscript "1" referring here, and in the rest of the text, to the diffuser inlet. The equation for the diffuser width is:

$$W = W_1 + 2\Delta x\tan\theta \tag{2}$$

Written for a distance from diffuser inlet of $\Delta x=0.5W_1$, equation (1) becomes:

$$\frac{A}{A_1} = \frac{W}{W_1} = 1 + \tan\theta \tag{3}$$

For annular diffusers use is made of the corresponding two-dimensional straight-wall diffuser angle $\theta_{EFF}$ which is defined by equation:

$$\frac{A}{A_1} = 1 + \frac{\Delta A}{A_1} = 1 + 2\left(\frac{\Delta x}{h_1}\right)\tan\theta_{EFF} \tag{4}$$

where the letter $h_1$ refers to the height of the diffuser at inlet and $\Delta A=A-A_1$. In the literature symbol $\Delta R_1$ is often used in place of $h_1$.

Uniform and Incompressible Flow

Test results reported by G. Sovran and E. D. Klomp in an article: "Experimentally Determined Optimum Geometries for Rectilinear Diffusers with Rectangular, Conical or Annular Cross Section" in Fluid Mechanics of Internal Flow, Elsevier Publishing Company, Amsterdam, Netherlands, 1967, and test results reported in "Steam Turbines for Large Power Outputs," von Karman Institute for Fluid Dynamics, Lecture Series 1980–6, Rhode Saint Genese, Belgium, 1980, indicate that in annular diffusers having straight axes and uniform incompressible flow at inlet at high Reynolds numbers and small inlet area blockage by the boundary layers the optimal performance at a distance of $\Delta x=0.5\ h_1$ from inlet (or in diffusers of that length) occurs when the ratio of the cross-sectional area at that location to the inlet area $A/A_1$ is 1.10, that is, the optimal cross-sectional area increase is $(\Delta A/A_1)_{OPT}=0.10$. Such diffuser geometry results in the largest pressure gradient which boundary layer in the diffuser can sustain in the inlet region ($\Delta x=0.5\ h_1$) for a uniform and incompressible flow without permanent flow separation from the walls. According to extrapolated test results of Sovran and Klomp, the corresponding diffusion coefficient, also known as the pressure recovery coefficient, has a value somewhere between 0.1 and 0.2. From equation 4 it follows that the optimal corresponding two-dimensional straight-wall diffuser angle $\theta_{EFF}$ is 5.71 degrees. For an incompressible and uniform flow, the Continuity Equation, which represents the Law of Conservation of Mass, applied to the control volume bounded by the diffuser inlet section 1, section 2, and the walls, shown in FIG. 5 results in the following expression for the flow velocity at section 2:

$$U_{2,UF} = U_{1,UF}\frac{W_1}{W_2} = \frac{U_{1,UF}}{1 + 2\left(\frac{\Delta x}{W_1}\right)\tan\theta} \tag{5}$$

where subscript "UF" here, and elsewhere in the text, refers to the uniform flow conditions.

With the diffusion coefficient defined by:

$$C_P = \frac{P_2 - P_1}{\left(\frac{\rho U^2}{2}\right)_1} \tag{6}$$

the following equation can be written for the total pressure loss coefficient in the diffuser with uniform flow:

$$\left(\frac{\Delta P_t}{\rho U_1^2/2}\right)_{UF} = \left(\frac{P_1 - P_2}{\rho U_1^2/2}\right)_{UF} + 1 - \left(\frac{U_2}{U_1}\right)^2_{UF} = -(C_P)_{UF} + 1 - \frac{1}{\left(1 + 2\frac{\Delta x}{W_1}\tan\theta\right)^2} \tag{7}$$

where ρ denotes fluid density.

The (linear) Momentum Equation, applied to the same control volume, reads:

$$-\rho(U_{1,UF})^2 W_1 + \rho(U_{2,UF})^2 W_2 = P_1 W_1 - P_{2,UF} W_2 + \frac{1}{2}(P_1 + P_{2,UF})(W_2 - W_1) + F_{x,SHEAR,UF} \tag{8}$$

where the term $F_{x,SHEAR}$ represents the x-component of the viscous shearing force acting on diffuser walls. Making use of equation (5) it transforms into the following equation for the diffusion coefficient:

$$(C_p)_{UF} = \left(\frac{P_2 - P_1}{\rho U^2/2}\right)_{UF} = \frac{4\frac{\Delta x}{W_1}\tan\theta}{\left(1 + 2\frac{\Delta x}{W_1}\tan\theta\right)\left(1 + \frac{\Delta x}{W_1}\tan\theta\right)} + \frac{2F_{x,SHEAR,UF}}{(\rho U_1^2/2)_{UF} W_1\left(1 + \frac{W_2}{W_1}\right)} \tag{9}$$

The shearing force term can be written as:

$$\frac{2F_{x,SHEAR,UF}}{(\rho U_1^2/2)_{UF} W_1\left(1 + \frac{W_2}{W_1}\right)} = -2C_f\Delta\frac{\frac{x}{W_1}}{1 + \frac{\Delta x}{W_1}\tan\theta} \tag{10}$$

where $C_f$ denotes the mean skin friction coefficient for a turbulent boundary layer, which, for a representative Reynolds number based on distance of $5.4\times10^5$ has a value of, approximately, 0.0055. For $\Delta x=0.5\ W_1$ and $\theta=5.71$ degrees the shearing force term becomes equal to −0.005238, and equation (9) becomes:

$$(C_p)_{UF}=0.168 \tag{11}$$

which is the estimated optimal value of the diffusion coefficient for a uniform and incompressible flow in an annular diffuser whose cross-sectional area ratio at a distance of $\Delta x=0.5\ h_1$ from inlet is $A/A_1=1.10$. It agrees quite well with the value expected from the test data of Sovran and Klomp for the boundary layer inlet area blockage of 2%. From equation (7) the dimension-less total pressure loss coefficient becomes:

$$\left(\frac{\Delta P_t}{\rho U_1^2/2}\right)_{UF} = 0.00555 \tag{12}$$

The effect of boundary layer area blockage at the diffuser inlet on the optimal value of the diffusion coefficient will not be considered here because, since we are concerned only with the effect of wakes on diffuser performance, only the knowledge of an approximate value of the optimal diffusion coefficient is required.

Effect of Wakes

FIG. 6 shows a drawing of a two-dimensional straight-wall diffuser with a wake. Meaning of terms is indicated. Only one wake is shown and not all N wakes corresponding to N blades in order to clarify the description of the wakes.

For the velocity distribution, or profile, in the wake we will use the following often-used expression verified by experiments (see, for example equation (4) in article by P. G. Hill, U. W. Schaub, and Y. Senoo: "Turbulent Wakes in Pressure Gradients," Transactions of the ASME, Journal of Applied Mechanics, vol. 85, Series E, pp. 518–524, December 1963):

$$u = U\left[\left(1 - \frac{\beta}{2}\right) - \left(\frac{\beta}{2}\right)\cos\pi\frac{y}{\delta}\right] \tag{13}$$

where

U=free (or main) stream velocity u=flow velocity in the wake

β=relative wake depth $(U-u_{min})/U$ y=distance coordinate perpendicular to the wake δ=half-width of the wake $u_{min}$=smallest flow velocity in the wake Continuity Equation applied to the control volume bounded by the inlet and exit sections and the walls written for N wakes at diffuser inlet, where N denotes the number of blades shedding wakes, and incompressible flow results in equation:

$$2N\int_0^{\delta_1} u_1 dy + (W_1 - 2N\delta_1)U_{1,W} = 2N\int_0^{\delta_2} u_2 dy + (W_2 - 2N\delta_2)U_{2,W} \tag{14}$$

from which the following equation for the free (or main) stream velocity at section 2 follows:

$$U_{2,W} = U_{1,W}1 - \frac{\beta_1\left(\frac{N\delta_1}{W_1}\right)}{\left(1 + 2\frac{\Delta X}{W_1}\tan\delta\right) - \beta_2\left(\frac{N\delta_1}{W_1}\right)\left(\frac{\delta_2}{\delta_1}\right)} \tag{15}$$

The subscript "W" refers here, and elsewhere in the text, to the flow with wakes.

The (linear) Momentum Equation takes the form:

$$2N\rho\int_0^{\delta_2} u_2^2 dy + (W_2 - 2N\delta_2)\rho U_2^2 - 2N\rho\int_0^{\delta_1} u_1^2 dy - (W_1 - 2N\delta_1)\rho U_1^2 = P_1W_1 - P_2W_2 + \frac{1}{2}(P_1 + P_2)(W_2 - W_1) + F_{x,SHEAR,W} \tag{16}$$

which yields the following equation for the diffusion coefficient:

$$(C_p)_W = \left(\frac{P_2 - P_1}{\rho U_1^2/2}\right)_W = \left[\frac{8\left(\frac{N\delta_1}{W_1}\right)\left(\frac{\delta_2}{\delta_1}\right)\left(1 - \frac{3}{8}\beta_2\right)\beta_2 - 4\left(\frac{W_2}{W_1}\right)}{1 + \frac{W_2}{W_1}}\right] \frac{\left[1 - \beta_1\left(\frac{N\delta_1}{W_1}\right)\right]^2}{\left[\left(1 + 2\frac{\Delta X}{W_1}\tan\theta\right) - \beta_2\left(\frac{N\delta_1}{W_1}\right)\left(\frac{\delta_2}{\delta_1}\right)\right]^2} - \frac{\left[8\left(\frac{N\delta_1}{W_1}\right)\left(1 - \frac{3}{8}\beta_1\right)\beta_1 - 4\right]}{1 + \frac{W_2}{W_1}} + \frac{2F_{x,SHEAR,W}}{(\rho U_1^2/2)_W W_1\left(1 + \frac{W_2}{W_1}\right)} \tag{17}$$

Subtracting equation (9) from equation (17) assuming that the dimension-less wall shearing force term for the flow with wakes is the same as for the uniform flow, we obtain the following equation for the diffusion coefficient in a flow with wakes:

$$(C_p)_W = (C_p)_{UF} + \frac{\left[4\left(\frac{N\delta_1}{W_1}\right)\left(\frac{\delta_2}{\delta_1}\right)\left(1 - \frac{3}{8}\beta_2\right)\beta_2 - 2\left(1 + 2\frac{\Delta X}{W_1}\tan\theta\right)\right]\left[1 - \beta_1\left(\frac{N\delta_1}{W_1}\right)\right]^2}{\left(1 + \frac{\Delta x}{W_1}\tan\theta\right)\left[\left(1 + 2\frac{\Delta X}{W_1}\tan\theta\right) - \beta_2\left(\frac{N\delta_1}{W_1}\right)\left(\frac{\delta_2}{\delta_1}\right)\right]^2} - \frac{4\left(\frac{N\delta_1}{W_1}\right)\left(1 - \frac{3}{8}\beta_1\right)\beta_1 - 2}{1 + \frac{\Delta x}{W_1}\tan\theta} - \frac{4\frac{\Delta x}{W_1}\tan\theta}{\left(1 + 2\frac{\Delta X}{W_1}\tan\theta\right)\left(1 + \frac{\Delta X}{W_1}\tan\theta\right)} \tag{18}$$

The assumption made in the derivation of the last equation is acceptable because the wakes when they are deep affect only a small fraction of the diffuser walls, and when they are shallow the smallest velocity in them has magnitude not much different from that of the free stream.

The equation for the average total pressure loss coefficient for the flow with wakes, with $\Delta P_t = P_{t1} - P_t$, can be written as:

$$\left(\frac{\Delta P_t}{\rho U_1^2/2}\right)_W = -(C_p)_W + \frac{1 - 2\left(\frac{N\delta_1}{W_1}\right)}{1 - \left(\frac{N\delta_1}{W_1}\right)\beta_1} + \left(1 - \beta_1 + \frac{3}{8}\beta_1^2\right)\left(\frac{N\delta_1}{W_1}\right)\frac{(2 - \beta_1)}{1 - \left(\frac{N\delta_1}{W_1}\right)\beta_1} - \left(\frac{U_2}{U_1}\right)_W^2\left[\frac{1 - 2\left(\frac{N\delta_1}{W_1}\right)\left(\frac{W_1}{W_2}\right)\frac{\delta_2}{\delta_1}}{1 - \left(\frac{N\delta_1}{W_1}\right)\left(\frac{W_1}{W_2}\right)\frac{\delta_2}{\delta_1}\beta_2} + \left(1 - \beta_2 + \frac{3}{8}\beta_2^2\right)\left(\frac{N\delta_1}{W_1}\right)\left(\frac{W_1}{W_2}\right)\left(\frac{\delta_2}{\delta_1}\right)\frac{(2 - \beta_2)}{1 - \left(\frac{N\delta_1}{W_1}\right)\left(\frac{W_1}{W_2}\right)\left(\frac{\delta_2}{\delta_1}\right)\beta_2}\right] \tag{19}$$

For two-dimensional turbulent wakes $\delta \sim \sqrt{x}$ and $\beta \sim 1/\sqrt{x}$ (see: F. M. White: Viscous Fluid Flow, McGraw-Hill Book Company, 1974, p. 511, and H. Schlichting, "Boundary Layer Theory" McGraw-Hill Book Company, 7$^{th}$ edition, 1979, p. 734). As a result:

$$\frac{\delta_2}{\delta_1} = \sqrt{1 + \frac{\Delta x}{x_1}} \tag{20}$$

and $$\frac{\beta_2}{\beta_1} = \frac{1}{\sqrt{1 + \frac{\Delta x}{x_1}}} \tag{21}$$

where $x_1$ denotes the distance measured from the point of formation of wakes to diffuser inlet, which in turbines represents the average distance from the trailing edges of the wake-generating blades to diffuser inlet. We will take, as a representative value, $\Delta x/x_1 = 10$, for which:

$$\frac{\delta_2}{\delta_1} = 3.32 \tag{22}$$

and $$\frac{\beta_2}{\beta_1} = 0.30 \tag{23}$$

Two types of wakes are of interest when analyzing a flow in gas turbine diffusers: thick wakes which form when the unit operates at partial power and flow rate, and as a consequence at low diffuser inlet Mach numbers, and the flow separates from last stage blades as a result of a large incidence angle on the blades which is then created (mainly in turbines which are not equipped with adjustable nozzles), and thin wakes which form when a unit operates at or near design conditions, at higher diffuser inlet Mach numbers, at which no separation of flow from last blades is to be expected. In this analysis it will be assumed that thick wakes occur when the inlet flow Mach number to the diffuser is about 0.3, and the thin wakes when it is about 0.5. [According to the book "Gas Turbine Performance" by P. P. Walsh and P. Fletcher, published in 1998 by Blackwell Science Ltd., Oxford, England, and the ASME of Fairfield, N.J., pages 206 and 220, the final turbine stage exit flow Mach number should be around 0.3, with the highest allowable being 0.55. The authors state that at higher Mach numbers "dramatic breakdown in flow may occur in the downstream diffusing duct such as an exhaust, jet pipe or inter-turbine duct." In exhausts of industrial gas turbines, in both the high-pressure (or cold-end) turbine and in the low-pressure (or hot-end) turbine the flow Mach number should be in the range of 0.3 to 0.5.]

For the thin wakes we will take $N\delta_1/W_1=0.05$, where $W_1$ corresponds to the N spaces between the turbine last blades, or blade spacings, which means that the wakes at diffuser inlet extend to 10 percent of the flow area there since the wake thickness is $2\delta$. [This value corresponds closely to that of the wake which forms after a 26-inch last stage blade of a steam turbine at design conditions whose photograph is shown in FIG. 17 of article by M. F. O'Connor, K. E. Robbins and J. C. Williams: Redesigned 26-inch Last Stage for Improved Turbine Reliability and Efficiency" Paper presented at the ASME/IEEE Joint Power Generation Conference, Sept. 17, 1984, Toronto, Ontario, Canada.] The value of $N\delta_1/W_1=0.05$ is in reasonably good agreement with the calculated turbulent boundary layer thickness for average spacings between last gas turbine blades. The thick wakes at diffuser inlet, which form from separated flow on the final blades, can be expected to be at least twice as thick as the thin wakes and we will take $N\delta_1/W_1=0.10$ for them.

For the flow with thick wakes, with $N\delta_1/W_1=0.10$, for $\Delta x=0.5\ h_1$, with $\beta_1=0.8$, $\beta_2=0.30\beta_1=0.24$ and $\delta_2/\delta_1=3.32$, for the required value of the diffusion coefficient for a separation-free flow at optimum performance $(C_p)_w=0.168$, equations (9) and (18) are satisfied for the angle $\theta=4.0$ degrees, at which $(C_p)_{UF}=0.121$. This result indicates that in this case the wakes contribute 0.168−0.121=0.047, or 28 percent, to the diffusion coefficient and the pressure gradient. The total pressure coefficient, obtained from equation (19), is 0.00704, which can be compared to the value of 0.005242 for uniform flow obtained from equation (7).

For the flow with thin wakes, with $N\delta_1/W_1=0.05$, $\Delta x=0.5\ h_1$, $\beta_1=0.8$, $\beta_2=0.30\beta_1=0.24$ and $\delta_2/\delta_1=3.32$ for the required value of the diffusion coefficient for a separation-free flow at optimum performance $(C_p)_w=0.168$, equations (9) and (18) are satisfied for the angle $\theta=4.9$ degrees at which $(C_p)_{UF}=0.146$. This result indicates that in this case the wakes contribute 0.168−0.146=0.022, or 13 percent to the diffusion coefficient and to the pressure gradient. The total pressure loss coefficient, obtained from equation (19), is 0.005902, which can be compared to the value of 0.005297 for a uniform flow obtained from equation (7).

The above results were obtained for a two-dimensional straight-wall diffuser having its wall angle equal to the corresponding two-dimensional straight-wall diffuser angle of an annular diffuser $\theta=\theta_{EFF}=5.71$ degrees which corresponds to the annular diffuser optimal area ratio $A/A_1=1.10$ at $\Delta x=0.5\ h_1$ for a uniform incompressible flow at inlet and thus represent an acceptable estimate for the optimal conditions in the annular diffuser. The calculations were made so as to ensure that the results obtained are conservative. For the ratio $\Delta x/x_1$ a value of 10 was used although a smaller value would also be appropriate. Similarly, the value of $\beta_1$ was chosen to be 0.8 although it may well be closer to 1.0 especially for the thick wakes. Both of these choices make the calculated allowable diffuser cross-sectional area increases larger than they would be otherwise.

And so we have found that for an incompressible flow in an annular diffuser, at a distance $\Delta x=0.5\ h_1$, the optimal performance corresponds to the following:

for a uniform flow at inlet $$\frac{\Delta A}{A_1}=0.10 \text{ or } \frac{A}{A_1}=1.10,\ \theta_{EFF}=5.71°,\ C_p=(C_p)_{OPT}\cong 0.168$$

for a flow with thick wakes [with $C_p=(C_p)_{OPT}=0.168$, and $(C_p)_{AREA\ CHANGE}=0.121$]

$$\theta_{EFF}=4.0° \text{ and } \frac{\Delta A}{A_1}=\tan 4.0°=0.070, \text{ or } \frac{A}{A_1}=1.070$$

indicating that a 30 percent reduction of the diffuser cross-sectional area increase is required to ensure an optimal performance flow without a permanent separation when compared with a uniform flow, for a flow with thin wakes [with $C_p=(C_p)_{OPT}=0.168$, and $(C_p)_{AREA\ CHANGE}=0.146$]

$$\theta_{EFF}=4.9° \text{ and } \frac{\Delta A}{A_1}=\tan 4.9°=0.0857, \text{ or } \frac{A}{A_1}=1.0857$$

indicating that a 14.3 percent reduction of the diffuser cross-sectional area is required to ensure an optimal performance flow without a permanent separation when compared with a uniform flow. Subscript "OPT" refers to the optimal diffusion conditions.

Effect of Compressibility

Tests have shown that in a subsonic flow, the compressibility of the fluid, that is the flow Mach number, has no significant measurable effect on the value of the optimal diffusion coefficient. (Refer, for example, to FIG. 21 in CREARE Technical Note TN-186 of May 1975 entitled Diffuser Data Book by P. W. Runstadler, Jr., F. X. Dolan, and R. C. Dean, Jr., or to NASA Report CR-2299 of July 1973 entitled Pressure Recovery Performance of Conical Diffusers at High Subsonic Mach Numbers by F. X. Dolan and P. W. Runstadler.) For that reason the previous results obtained for an incompressible flow with the diffusion coefficient $(C_p)_{OPT,INC}=0.168$ can be used when applying a correction for compressibility to the area ratio-pressure rise relationship. The subscript "INC" refers to an incompressible flow, for which the flow Mach number $M\equiv 0$.

To account for the effect of compressibility of the gases leaving the gas turbine we will use equation:

$$\frac{\Delta A}{A_1}=(1-M^2)\left(\frac{\Delta A}{A_1}\right)_{INC} \tag{24}$$

for the (relative) diffuser cross-sectional area change. This method of correcting for compressibility of the fluid is based on the following equation which relates changes of the flow area to the changes of pressure in a flow without losses:

$$\frac{dA}{A}=(1-M^2)\frac{dP}{\rho U^2} \tag{25}$$

taken from "Fundamentals of Gas Dynamics" by the present inventor J. A. Owczarek, International Textbook Company, Scranton, Pa., 1964, equation (6–8) on page 201.

Equation (24) was derived from equation (25) by forming a ratio for two flows, one compressible and one incompressible, in which the total pressure losses are very small and in which the same fraction of the (optimal) diffusion coefficient ($C_p=0.168$) is produced by diffuser cross-sectional area change (the other fraction of the diffusion coefficient resulting from the process of decay of wakes).

The effect of compressibility will be evaluated for the inlet flow Mach numbers of 0.3 and 0.5 which, as was indicated earlier, should be representative of the thick wakes and thin wakes, respectively.

Making use of equation (24) we find that for a compressible flow the (relative) diffuser cross-sectional area increase required to achieve optimal diffuser performance (which occurs in a flow still free of permanent separation) at $\Delta x=0.5\ h_1$ is as follows:

Flow with thick wakes with diffuser inlet flow Mach number $M_1=0.3$ $$\frac{\Delta A}{A_1} = [1-(0.3)^2]\times 0.070 = 0.0637, \text{ or } \left(\frac{A}{A_1}\right)_{OPT} \cong 1.064$$

Flow with thin wakes with diffuser inlet flow Mach number $M_1=0.5$ $$\frac{\Delta A}{A_1} = [1-(0.5)^2]\times 0.0857 = 0.0643, \text{ or } \left(\frac{A}{A_1}\right)_{OPT} \cong 1.064$$

Another method which can be used to account for the effect of compressibility is one which treats the combustion gases in the diffuser as ideal gases having constant specific heats, with the ratio of specific heats $\gamma=1.3$.

The expression for the diffusion coefficient is re-written in the form:

$$C_p = \frac{\left(\frac{P}{P_t}\right)\left(\frac{P_t}{P_{tl}}\right)-\left(\frac{P}{P_t}\right)_1}{\left(\frac{\rho U^2}{2P_t}\right)_1} \tag{26}$$

where $P_t$ refers to the total pressure of the flowing fluid. From the last equation we obtain expression:

$$\frac{P}{P_t} = \frac{C_p\left(\frac{\rho U^2}{2P_t}\right)_1+\left(\frac{P}{P_t}\right)_1}{\frac{P_t}{P_{tl}}} \tag{27}$$

with $$\frac{P_t}{P_{tl}} = 1-\frac{\Delta P_t}{P_{tl}} = 1-\frac{\Delta P_t}{(\rho U^2/2)_1}\left(\frac{\rho U^2}{2P_t}\right)_1 \tag{28}$$

Since, $$\frac{A}{A_1} = \left(\frac{A}{A_*}\right)\left(\frac{A_{*1}}{A_1}\right)\left(\frac{A_*}{A_{*1}}\right) \tag{29}$$

where A* denotes the critical flow area at which the flow Mach number M=1.0, with:

$$\frac{A_*}{A_{*1}} = \frac{P_{tl}}{P_t}$$

valid for flows in which the total enthalpy is constant, because the critical mass flow rates for states at sections 1 and 2 are the same, (see equation on page 205 of "Fundamentals of Gas Dynamics" referred to earlier), we can determine the optimal area ratio $A/A_1$ at $\Delta x=0.5\ h_1$.

The compressible flow equations from the already referred to book "Fundamentals of Gas Dynamics" by J. A. Owczarek, equations (4-142), (4-150), and (6-12) for the ratio of specific heats $\gamma=1.3$ give the following ratios for the inlet flow Mach number $M_1=0.3$ $$\left(\frac{P}{P_t}\right)_1 = 0.9435, \left(\frac{\rho U^2}{2P_t}\right)_1 = 0.055195, \text{ and } \frac{A_1}{A_{*1}} = 2.054$$

For the diffusion coefficient $C_p=0.121$ [which represents the contribution to the overall diffusion coefficient $(C_p)_{OPT}=0.168$] coming from diffuser area change, and the total pressure ratio:

$$\frac{P_t}{P_{tl}} = 1-0.00704\times 0.055195 = 0.99961$$

equation (27), compressible flow equations, and equation (29) yield:

$$\frac{P}{P_t} = 0.95055,\ M = 0.280,\ \frac{A}{A_*} = 2.1860,$$

$$\text{and } \frac{A}{A_1} = \frac{2.1860}{2.054\times 0.99961} = 1.0647$$

which should be compared to the value of 1.0637 obtained using equation (24). The average value of the ratio $A/A_1$ obtained using the two methods is thus 1.0642.

It is also of interest to note that if the diffuser inlet flow were uniform, that is, if there were no wakes present, then the optimal diffuser cross-sectional area increase would have been larger. For example, for $\Delta x=0.5\ h_1$ and $M_1=0.3$ the optimal area ratio would be $(A/A_1)=1+[1-(0.3)^2]\times 0.10=1.091$ and not 1.064. (The area ratio of 1.091 is close to the value of 1.085 for the prior art diffuser shown in FIG. 2, see description of FIG. 2.)

Recommendation

On the basis of the results obtained, and in view of the fact that the thickness of the thick wakes which form at the off-design operating conditions at which the diffuser inlet flow Mach number is low may be larger than the value assumed in this analysis, which would make the optimal area ratio smaller than calculated, it is recommended that the necessary criterion for the optimal performance of annular diffusers of gas turbines and for the prevention of flow separation from diffuser walls be $$\frac{A}{A_{INLET}} \le 1.065 \tag{30}$$

at a distance from diffuser inlet of one half of the diffuser inlet height measured along diffuser mean line, or that at the same distance the corresponding two-dimensional straight-wall diffuser angle, obtained from equation (4), be limited to $$\theta_{EFF} \le 3.7° \tag{31}$$

with the rate of cross-sectional area increase at larger distances corresponding mainly to the optimal rate determined for an incompressible uniform flow corrected for the effect of compressibility.

I claim:

1. An annular diffuser at the exit of a turbine of a gas turbine unit in which at a distance of one half of the diffuser height at its inlet measured along a mean line from the inlet the cross-sectional area increase of the diffuser is not larger than 6.5 percent of the cross-sectional area at inlet.

2. The annular diffuser of claim 1 in which the tangent to the outer diffuser wall at inlet is horizontal.

3. The annular diffuser of claim 1 in which the tangents to both the outer and the inner diffuser walls are horizontal.

4. The annular diffuser of claim 1 in which the radius of curvature of the outer wall at diffuser inlet is larger than or equal to one half of the diffuser height at inlet.

5. An annular diffuser at the exit of a turbine of a gas turbine unit in which at a distance of one half of the diffuser height at its inlet measured along a mean line from the inlet the corresponding two-dimensional straight-wall diffuser angle is 3.7 degrees or less.

6. The annular diffuser of claim 5 in which the tangent to the outer diffuser wall at inlet is horizontal.

7. The annular diffuser of claim 5 in which the tangents to both the outer and the inner diffuser walls are horizontal.

8. The annular diffuser of claim 5 in which the radius of curvature of the outer wall at diffuser inlet is larger than or equal to one half of the diffuser height at inlet.

9. An annular diffuser at the exit of a turbine of a gas turbine unit in which at a distance of one half of the diffuser height at its inlet measured along a mean line from the inlet the cross-sectional area increase of the diffuser is not larger than 5.2 percent of the cross-sectional area at inlet.

10. An annular diffuser at the exit of a turbine of a gas turbine unit in which at a distance of one half of the diffuser height at its inlet measured along a mean line from the inlet the corresponding two-dimensional straight-wall diffuser angle is 3.0 degrees or less.

11. An annular diffuser at the exit of a turbine of a gas turbine unit in which at a distance of one half of the diffuser height at its inlet measured along a mean line from the inlet the cross-sectional area increase of the diffuser is not larger than 4.4 percent of the cross-sectional area at inlet.

12. An annular diffuser at the exit of a turbine of a gas turbine unit in which at a distance of one half of the diffuser height at its inlet measured along a mean line from the inlet the corresponding two-dimensional straight-wall diffuser angle is 2.5 degrees or less.

* * * * *

UNITED STATES PATENT AND TRADEMARK OFFICE

CERTIFICATE OF CORRECTION

PATENT NO. : 6,488,470 B1 
DATED : December 3, 2002
INVENTOR(S) : Jerzy A. Owczarek It is certified that error appears in the above-identified patent and that said Letters Patent is hereby corrected as shown below:

Column 8,
Line 7, at end of line the term "$n_2$" should read -- $n_1$ --.
Line 8, the term "$m_2$" should read -- $m_1$ --.

Column 13,
Lines 57-63, equation 10, $$\frac{2F_{x,SHEAR,UF}}{(\rho U_1^2/2)_{UF} W_1\left(1+\frac{W_2}{W_1}\right)} = -2C_f\Delta\frac{\frac{x}{W_1}}{1+\frac{\Delta x}{W_1}\tan\theta} \qquad (10)$$

should read $$\frac{2F_{x,SHEAR,UF}}{(\rho U_1^2/2)_{UF} W_1\left(1+\frac{W_2}{W_1}\right)} = -2\frac{C_f\frac{\Delta x}{W_1}}{1+\frac{\Delta x}{W_1}\tan\theta} \qquad (10)$$

Column 15,
Lines 1-5, equation 15, $$U_{2,W} = U_{1,W}1 - \frac{\beta_1\left(\frac{N\delta_1}{W_1}\right)}{\left(1+2\frac{\Delta X}{W_1}\tan\delta\right)-\beta_2\left(\frac{N\delta_1}{W_1}\right)\left(\frac{\delta_2}{\delta_1}\right)} \qquad (15)$$

should read $$U_{2,W} = U_{1,W}\frac{1-\beta_1\left(\frac{N\delta_1}{W_1}\right)}{\left(1+2\frac{\Delta x}{W_1}\tan\theta\right)-\beta_2\left(\frac{N\delta_1}{W_1}\right)\left(\frac{\delta_2}{\delta_1}\right)} \qquad (15)$$

Line 32, in equation 17 the capital letter "X" should be replaced with the lower case -- x --.
Between lines 48 and 60, in equation 18 in three separate instances the capital letter "X" should in each case be replaced with the lower case -- x --.

Signed and Sealed this

Twenty-ninth Day of April, 2003

JAMES E. ROGAN
*Director of the United States Patent and Trademark Office*